US008529026B2

(12) United States Patent
Clarke et al.

(10) Patent No.: US 8,529,026 B2
(45) Date of Patent: Sep. 10, 2013

(54) DROPLET GENERATOR

(75) Inventors: Andrew Clarke, Haslingfield (GB); Nicholas J. Dartnell, Longstanton (GB); Christopher B. Rider, Hardwick (GB)

(73) Assignee: Eastman Kodak Company, Rochester, NJ (US)

( * ) Notice: Subject to any disclaimer, the term of this patent is extended or adjusted under 35 U.S.C. 154(b) by 0 days.

(21) Appl. No.: 13/257,377

(22) PCT Filed: Mar. 9, 2010

(86) PCT No.: PCT/US2010/000700

§ 371 (c)(1),
(2), (4) Date: Dec. 6, 2011

(87) PCT Pub. No.: WO2010/110842

PCT Pub. Date: Sep. 30, 2010

(65) Prior Publication Data

US 2012/0075389 A1 Mar. 29, 2012

(30) Foreign Application Priority Data

Mar. 25, 2009 (GB) ..... 0905050.1
Jun. 30, 2009 (GB) ..... 0911316.8

(51) Int. Cl.
*B41J 2/02* (2006.01)

(52) U.S. Cl.
USPC ..... 347/73

(58) Field of Classification Search
USPC ..... 347/73–82, 89, 90
See application file for complete search history.

(56) References Cited

U.S. PATENT DOCUMENTS

| | | | |
|---|---|---|---|
| 6,377,387 | B1 | 4/2002 | Duthaler et al. |
| 2005/0161326 | A1 | 7/2005 | Morita et al. |
| 2005/0172476 | A1 | 8/2005 | Stone et al. |
| 2008/0044884 | A1 | 2/2008 | Hwang et al. |

FOREIGN PATENT DOCUMENTS

| | | |
|---|---|---|
| WO | WO 2006/022487 | 3/2006 |
| WO | WO 2009/004312 | 1/2009 |
| WO | WO 2009/004314 | 1/2009 |
| WO | WO 2009/004318 | 1/2009 |

OTHER PUBLICATIONS

Thorsen, T. et al., "Dynamic Pattern Formation in a Vesicle-Generating Microfluidic Device," *Physical Review Letters*, 86, 4163 (2001).

Utada, A.S. et al., "Dripping, Jetting, Drops, and Wetting: The Magic of Microfluidics," *MRS Bulletin*, vol. 32, pp. 702-708 (2007).

Anna, S. L. et al., "Formation of Dispersions Using 'Flow Focusing' in Microchannels," *Applied Physics Letters*, 82, 364 (2003).

Guillot, P. et al., "Stability of a Jet in Confined Pressure-Driven Biphasic Flows at Low Reynolds Numbers," *Physical Review Letters*, 99, 104502 (2007).

Utada, A. S. et al., "Dripping to Jetting Transitions in Coflowing Liquid Streams," *Physical Review Letters*, 99, 094502 (2007).

(Continued)

*Primary Examiner* — Kristal Feggins
(74) *Attorney, Agent, or Firm* — William R. Zimmerli

(57) ABSTRACT

A method and device for passively periodically perturbing the flow field within a microfluidic device to cause regular droplet formation at high speed.

38 Claims, 7 Drawing Sheets

(56) References Cited

OTHER PUBLICATIONS

Stone, H. A. et al., "Engineering Flows in Small Devices: Microfluidics Toward a Lab-on-a-Chip", *Annual Review of Fluid Mechanics*, vol. 36, pp. 381-411 (2004).

Cracknell, A. P., "Pohlmann Whistle", *Ultrasonics*, pp. 147-149 (1980).

Eggers et al., "Physics of Liquid Jets," *Rep. Prog. Phys.*, 71, (2008) 036607.

Krotov, V. V. et al., "Physicochemical Hydrodynamics of Capillary Systems," *Imperial College Press* (1999).

DROPLET GENERATOR

FIELD OF THE INVENTION

This invention relates to the field of microfluidic devices. More particularly the invention relates to an apparatus and method of forming droplets of a fluid.

BACKGROUND OF THE INVENTION

In recent years there has been an explosion of work demonstrating the formation of oil in water or water in oil droplets within microfluidic devices. The interest was initiated by pioneering work of the groups of Quake, (T Thorsen, R W Roberts, F H Arnold, and S R Quake, PRL 86, 4163 (2001)), Weitz (A S Utada, L-Y Chu, A Fernadez-Nieves, D R Link, C Holtze, and D A Weitz, MRS Bulletin 32, 702 (2007)) and Stone (S L Anna, N Bontoux, and H A Stone, Appl. Phys. Lett. 82, 364 (2003)), these papers both elucidating the behaviour of concentric multiphase flows and demonstrating exquisite control over synthesis of multiphase droplet systems. In all cases, the fundamental microfluidic component is a flow focusing arrangement that brings together two immiscible phases. Cascading such components has enabled water-in-oil-in-water-in-oil etc. systems to be created. Further, such microfluidic devices may be used as a general fabrication route to precisely control monodisperse materials, although such elemental devices would need to be fabricated massively in parallel in order that useful quantities of material may be made. Planar flow focusing devices have the utility of easy fabrication through the now well known PDMS fabrication process. Since PDMS is an intrinsically hydrophobic material it has been readily utilised to make water-in-oil systems that have been the particular focus for biological investigation where each droplet can be used as a reactor, for example for PCR reactions.

The particular interest in these microfluidic flow focusing systems stems from their ability to form precise monodisperse droplets, usually at rates up to a few kHz. Several papers have demonstrated that the formation of monodisperse droplets is the result of a flow instability associated with the two phase flow within a nozzle. Guillot et al (P Guillot, A Colin, A S Utada, and A Ajdari, PRL 99, 104502 (2007)) have shown that the flow instabilities associated with multiphase flow in such a flow focusing device can be described as either absolutely unstable, i.e. a dripping mode, or convectively unstable, i.e. a jetting mode. The jetting mode is a generalisation of the well known Rayleigh-Plateau instability of a free jet. A jet of one liquid within another will disintegrate into a series of droplets with a well defined average wavelength and therefore size irrespective of the flow rate. However in contrast to the flow focusing dripping mode the droplets will in general be polydisperse. In order to form monodisperse drops either the dripping or the geometry controlled drop formation mode is required. Utada (A S Utada, A Fernandez-Nieves, H A Stone, and D A Weitz, PRL 99, 094502 (2007)) has demonstrated that these modes are constrained to finite Capilliary and Weber number (Ca, We), that is the region where the growth of a perturbation propagates both upstream and downstream and is therefore absolutely unstable.

In order to take the exquisite control of droplet formation and synthesis afforded by microfluidic systems to a practical drop fabrication methodology, the ability to generate monodisperse droplets at significantly higher frequency is required. Further such methods then also become potentially useful as droplet generators for continuous inkjet.

WO2009/004314 and WO2009/004312 are examples of droplet formation in microfluidic devices.

Flow focusing devices are now well known in the art, for example see US2005/0172476. In these devices a first fluid phase that will become droplets is introduced via a middle channel and a second fluid phase that will become the surrounding carrier phase is typically introduced via at least two separated and symmetrically placed channels either side of the middle channel (systems with a single carrier phase channel also being known). Provided the walls of the channels supplying the carrier phase and the outlet channel are preferentially wetted by the carrier phase it will completely surround the first fluid phase which then breaks into droplets as the fluid flow is forced through a nozzle formed within the device.

In the prior art a common occurrence of obstructions in the context of a microfluidic device is by way of an array of pillars, in some instances activated or with a surface coating, that is used as an in-line filter or collection device (see for example US2008/0044884). These pillars are not intended to cause significant turbulence to the bulk flow. US2005/0161326 discloses in one embodiment an array of pillars in the flow channel slightly downstream of the intersection of the flow of two separate fluids. The pillars are deliberately added to cause non-laminar flow to aid the mixing of the two fluids to promote chemical reaction between the components, the two fluids being therefore miscible. WO2006/022487 also discloses an array of pillars in a flow channel but as a means of accelerating flow in the channel through an increase of the capillary force on the fluid. This usage is to quantitatively regulate the flow of a single fluid in a microfluidic device used for analytic or diagnostic purposes.

There is also earlier described a form of homogeniser which used ultrasonic vibration to break up into small droplets a jet of the liquid. The "Pohlmann Whistle" (see "Ultrasonics", p 147 to 149, by A. P. Cracknell, Wykeham publication 1980) is a jet-edge system in which the two liquids to be homogenised are forced through a nozzle to form a rectangular shaped jet which impinges upon a bevelled edge of a steel blade positioned downstream from the nozzle, which blade is typically cantilever mounted and which vibrates at its natural frequency being that required to break up the jet stream. High fluid velocities are required to induce this homogenisation and droplets formed are polydisperse.

The prior methods of size-controlled droplet generation of a fluid are limited to the low frequency dripping method referred to above (that is their frequency is limited by the necessity to keep the system in an absolutely unstable, i.e. dripping, regime) and active intervention method such as that in a continuous inkjet printhead using piezo crystals to generate droplets from a fluid.

PROBLEM TO BE SOLVED BY THE INVENTION

There is a need for a device and method for generating droplets of a fluid in a controlled manner with a low range of size dispersity at a rate sufficient for practical commercial use. There is a further need for low cost, broadly applicable drop generating device.

It is therefore an object of the invention to provide a device and method for making droplets of a fluid in a controlled manner and having a low degree of dispersity, which can therefore be used in a range of applications.

It is a further object to provide such a device and method which can operate at volumes sufficient for commercial use.

It is a still further object to provide such a device which is of low cost to manufacture.

SUMMARY OF THE INVENTION

The inventors have found that regular drop break-up of a fluid can be passively induced in a jet of said fluid by passing said fluid through a channel in a microfluidic device in which there is provided a means for passively creating flow instability of the fluid.

According, therefore, to a first aspect of the invention there is provided a method of controlling the formation of droplets of a droplet fluid composition from a jet of the droplet fluid composition, the method comprising providing a microfluidic device having at least one channel for the passage of the droplet fluid composition leading via an orifice to a droplet receiving space, providing a perturbing means for passively causing a flow instability within the channel, and causing the droplet fluid composition to pass through the channel at sufficient velocity to form a jet of said fluid emanating from the orifice whereby the fluid flow may be perturbed by the perturbation means for passively causing a flow instability thereby influencing the formation of droplets received in the droplet receiving space.

In a second aspect of the invention there is provided a microfluidic device for forming droplets of a droplet fluid composition the device comprising at least one channel for the passage of said droplet fluid composition, at least one outlet orifice leading to a droplet receiving space and a means for creating a flow velocity of the droplet fluid within the channel, wherein the at least one channel is provided with a perturbation means for passively creating flow instability of fluid passing through the channel whereby droplets of fluid are formed from a jet of said fluid exiting the orifice into the droplet receiving space in a regular manner that is influenced by creation of flow instability in the fluid.

In a third aspect of the invention there is provided a microfluidic device for forming droplets of a droplet fluid composition, the device comprising at least one channel for the passage of said droplet fluid composition, at least one orifice leading to a droplet receiving space and a means for creating a flow velocity of the droplet fluid within the channel sufficient to generate a jet of fluid through the orifice, wherein the at least one channel is provided with at least one bluff body.

In a fourth aspect of the invention there is provided a use of a microfluidic device, comprising at least one channel for the passage of fluid, at least one outlet orifice and a perturbation means for creating fluid flow instability through the channel, for controlling the formation of droplets of a droplet fluid composition into a droplet receiving space, by passing the droplet fluid phase through the device at a velocity sufficient to cause a jet of said fluid to emanate from the outlet orifice and to induce the perturbation means to create fluid flow instability in the channel.

In a fifth aspect of the invention, there is provided a method of influencing or controlling droplet formation from a jet of fluid emanating from an orifice of a microfluidic device, the method comprising inducing a vortex street to cascade through the orifice.

ADVANTAGEOUS EFFECT OF THE INVENTION

This invention enables controlled break-up of a jet of a fluid emanating from a channel through passively inducing unsteady flow within the fluid flow. The invention thereby enables control of the dispersity of droplet formation from a fluid jet having a high rate of droplet formation and thereby finds application in systems where monodisperse droplets or droplets of fluid within a defined range of dispersities from the mean are beneficial.

BRIEF DESCRIPTION OF THE DRAWINGS

The invention will now be described with reference to the accompanying drawings in which.

DETAILED DESCRIPTION OF THE INVENTION

Figure 1:
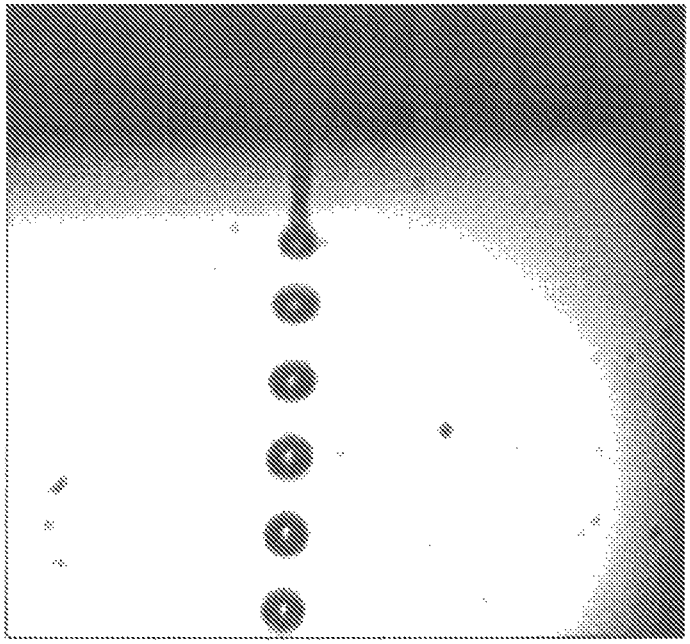
FIG. 1 relates to an embodiment of the invention in a simple configuration in which the droplet fluid is pumped through a T-piece device and show the resulting regular water jet break-up in air.

Using a microfluidic device comprising a channel with an orifice leading to a droplet receiving space, a fluid passing through the orifice with a sufficient flow velocity to form a jet of said fluid through the orifice may be manipulated such that the jet breaks up in a monodisperse manner or in a narrowly defined breadth of dispersity. According to the present invention, the form of this manipulation is to passively create a flow instability in the fluid passing through the channel by providing a perturbation means.

The fluid passing through the orifice comprises a droplet fluid composition, by which it is meant a fluid of the composition from which droplets will form in a regular manner in response to the flow instability created. By 'droplet fluid composition' it is meant a droplet fluid which may consist essentially of one, single (perhaps, pure) material or component arranged to form a fluid or which may comprise a mixture or amalgamation of component materials. The fluid composition may comprise a single fluid or fluid phase or more than one fluid or fluid phase in a mixture or flowing adjacently or sequentially through the channel. The droplet fluid composition may be a single phase or multiphase system (e.g. adjacent or laminar flow of two phases, such as a droplet fluid phase and a carrier fluid phase). Optionally, there may be multiple or immiscible fluid phases within the fluid passing through the orifice (for example a second droplet fluid composition or a carrier phase, which optionally forms droplets containing droplets of the droplet phase). Preferably, the droplet fluid composition is a substantially single phase fluid. Preferably, the droplet fluid composition consists essentially of the droplet fluid phase.

The droplet fluid composition (or droplet fluid phase) may itself carry dissolved or dispersed therein particles or reagents according to the purpose of the droplet formation or, for example particulates, dispersant, surfactant, polymer, oligomer, monomer, solvent, biocide, salt, excipient, cross-linking agent and/or precipitation agent. Optionally, it may contain microdroplets (by which it is meant droplets sufficiently small as to have a minimal influence of the flow characteristics of the droplet fluid composition within the channel and about a perturbation means) of an immiscible dispersed phase (which may contain particles, reagents, etc, as above).

The droplet fluid composition (or droplet fluid phase) may be predominantly a gas or a liquid phase. Preferably, for most applications, the droplet fluid composition (or the droplet fluid phase) is a liquid phase, which may for example be aqueous or non-aqueous (e.g. solvent or oil phase) depending upon the particular application requirements.

In the remainder of this document, the invention and its preferred and alternative embodiments shall be described in relation to a droplet fluid composition or droplet fluid, or in terms of the preferred 'droplet fluid phase' embodiment. Where 'droplet fluid phase' is referred to, it is intended that the embodiment being described is applicable also to droplet fluid compositions more generally as defined above where the context allows.

The flow instability may be any such instability that can form in a fluid flowing through a channel whereby the flow instability, or the effects thereof, cascade to the orifice and have an influence on and/or control the break up of a jet of the fluid emanating therefrom. Preferably, the flow instability created is periodic, or is created periodically, or regular whereby the break up of the jet of fluid emanating from the orifice is influenced and/or controlled to be periodic or regular. The flow instability may be caused, for example, by the creation of a series of unsteady eddies within the channel. Preferably, the flow instability is caused by the shedding, preferably periodic or regular, of vortices. Most preferably the flow instability is due to a vortex street in the droplet fluid in the channel. The flow instability is preferably caused by a perturbation means, which is preferably provided within the channel.

The perturbation means may be any such means for passively creating the flow instability, such as a geometrical arrangement of the channel. Examples of such perturbation means include a corner or junction in the at least one channel of a microfluidic device. Where there is a junction, the at least one channel may comprise of an upper portion or inlet portion (upstream of the junction) and a lower portion or outlet portion (downstream of the junction). In the case of a junction forming the perturbation means, this may be at the junction of the one or more upper portions with the one or more lower portions. The utilisation of such a junction as a perturbation means depends on other factors such as the identity of the fluid, the flow velocity of the fluid, the channel width, the distance of the perturbation means from the orifice and the size of the orifice. The perturbation means may alternatively be a bluff body such as a protrusion from the side wall (including floor or ceiling) of a channel or a pillar formed within the channel. Were the perturbation means is a bluff body in a device having at least one upper portion and at least one lower portion of the channel which meet at a corner or junction, the perturbation means may be provided in one or more upper or lower portion, (and is preferably provided in a lower portion), provided that the flow instability caused thereby (or effects thereof) permeates to the orifice where it can influence and/or control droplet formation.

The perturbation means is any means that passively causes boundary layer separation. The perturbation means may include bluff bodies placed within a channel of constant cross-section or it may include changes to the geometry of the channel cross-section, for example constrictions, corners or junctions. A bluff body may extend partially into the flow, or cross a flow channel allowing liquid (or other fluid) to pass either side. Such a body may be hard or may be deformable. It may be passive such as, but not restricted to, a polymeric rod. Alternatively it may be, for example, a bimetallic strip or a heated wire or rod, but still capable of passively inducing flow instability as a bluff body.

Preferably, the perturbation means is a bluff body provided in the at least one channel carrying the droplet fluid composition. Most preferably, the bluff body is a pillar formed within the channel.

By passively creating a flow instability, it is meant creating a flow instability that is not driven (e.g. mechanically or electrically) other than by the droplet fluid composition flow itself in concert with the perturbation means. A means for passively creating a flow instability may move in response to the flow past it or through it, but is not driven to create the flow instability by for example electrical impulses.

In the otherwise laminar flow of fluid through a channel having such a perturbation means, vortices or eddies may be established downstream of the perturbation means at a certain flow rate. If this perturbation means or other element of the device is deformable or capable of oscillating (e.g. in response to the fluid flow), this may interact with the eddies or vortices to establish an oscillation causing a perturbation (or flow instability) further downstream from the perturbation means. Depending upon factors, such as the oscillation established and distance downstream the perturbation permeates or has effect, this may enable the break up of drops to be influenced or controlled according to the invention. An oscillating perturbation means (e.g. bluff body) may have the effect of shifting the frequency of vortex shedding relative to a corresponding rigid perturbation means. In addition, a flow instability at the orifice may be generated at lower velocity than otherwise.

Unstable vortices, being a form of flow instability, are created in a fluid flow above a critical Reynolds number, at which point vortices are shed from the perturbation means. Regular shedding of unstable vortices is referred to as von Karman vortex shedding. According to a preferred embodiment of the present invention, unstable vortices or shed vortices periodically perturb a jet of the droplet fluid and initiate jet break up. In most systems, it is necessary that the droplet fluid phase is pumped through the device. Recognising that microfluidic devices such as the present invention may readily be cascaded, it will also be recognised that the droplet fluid composition of any given microfluidic device may itself be a combination of the droplet and carrier phases of a previous microfluidic device in a cascade.

By a regular manner, by which fluid exiting the orifice into the droplet receiving space is formed into droplets according to the configuration of a microfluidic device of the present invention, it is meant droplets are formed in a manner (e.g. degree of dispersity or range of polydispersity) consistent with the dispersity requirements for the purpose for which the narrow range of sizes of droplets is being generated. Preferably, the regular manner is consistent with the fluid flow having a velocity such that the critical Reynolds number for the system is met or exceeded.

In fluids flowing through a channel, the point at which vortices shed as a result of manipulation of the flow (e.g. by a bluff body positioned within the channel) is governed by the Reynolds number.

A von Karman vortex street, for example, is a repeating pattern of swirling vortices caused by the unsteady separation of flow around a perturbation means (e.g. bluff body) in a fluid flow. (This process is responsible for such phenomena as the singing of telephone wires, the fluttering of flags etc). A vortex street will be observed in a microfluidic device provided with, for example, a bluff body for flows above a critical Reynolds number ($Re=\rho Ud/\eta$; $\rho$ the density in $kg/m^3$, U the fluid velocity in m/s, d the diameter of the bluff body in m, and $\eta$ the fluid viscosity in Pa·s). The critical Reynolds number is therefore a function of the density of the fluid and the viscosity of the fluid. It thereafter depends upon the diameter and/or geometry of the perturbation means (e.g. bluff body). Having regard for a fluid of a certain density and viscosity and for the geometry of the perturbation means (e.g. bluff body) in the microfluidic device being used, the Reynolds number will be reached if the fluid is passed through the device with sufficient flow velocity. The range of Reynolds number over which vortices are shed will vary depending on the kinematic viscosity and shape of the perturbation means, e.g. bluff body, but is typically $47<Re<10^7$ (for circular cylinders). As vortices are shed then an alternating transverse force is experienced by or associated with the perturbation means, such as a bluff body.

If the perturbation means, e.g. a bluff body such as a pillar, can deform, move or oscillate (e.g. in response to fluid flow) and the frequency of shedding is comparable to the natural frequency of the body, then resonance can ensue. In many engineering systems vortex shedding and the induced resonance are detrimental and many inventions exist to suppress this phenomenon, particularly for suspended cables and towers.

However, in the present invention, such resonance or other interaction between vortex/eddy establishment or shedding and movement, deformation and/or oscillation of the perturbation means may have the effect of reducing the threshold Reynolds number. This has a possible advantage that in such a system periodic flow fluctuations or vortex shedding may thereby occur at lower fluid flow velocity than otherwise. This may be advantageous because at higher fluid flow rates, other factors associated with turbulence can begin to take effect, which may lead to uncontrolled turbulence to the detriment of control of droplet break up from the associated fluid jet. Further, within a microfluidic device, the highest flow velocity attainable will be limited by the pressure that the device can withstand, thus lower fluid velocity and thereby lower drive pressure may have advantage.

The frequency with which vortices are shed has an impact on the frequency (and therefore size) of break up into droplets of a jet of the fluid. The frequency of vortex shedding for a long circular cylinder is given by the empirical formula:

$$\frac{fd}{U} = 0.198\left(1 - \frac{19.7}{\mathrm{Re}}\right)$$

with f the frequency in Hz. This formula is typically valid for Re>250, but may be approximately valid at much lower Re (Reynolds number).

At lower Reynolds number vortices may exist downstream of the perturbation means, e.g. bluff body, and can set the body, for example, into resonance even without shedding vortices. Further, in a confined flow, such oscillations between flow to one side or the other of the perturbation means can occur and will again have a natural frequency depending on the flow rate and size/geometry of the perturbation means.

Such flow instabilities naturally affect the flow of fluid streams further downstream of the bluff body. At greater distances downstream, the viscosity of the fluid stream(s) may dissipate energy associated with the perturbation or flow instability and the flow fluctuations will decay away. The rate of decay depends on the viscosity, flow velocity and channel width (i.e. the smallest dimension of the channel). This distance is usually termed the entrance length for developed flow and is given approximately for laminar flow as $$\frac{L}{D} = 0.06\mathrm{Re} = 0.06\frac{\rho UD}{\eta}$$

with L the entrance length (m), D the channel width (m), Re the Reynolds number, r the density ($kg/m^3$), U the flow velocity (m/s) and h the liquid viscosity (Pa·s). For turbulent flow the approximation becomes, $$\frac{L}{D} = 4.4\mathrm{Re}^{1/6} = 4.4\left(\frac{\rho UD}{\eta}\right)^{1/6}$$

We can characterise the fluid flow through the channel in various ways, for example as: purely laminar flow with no turbulence (this would be the case for a low velocity fluid flow through a channel, especially where there is no perturbation means); laminar flow with controlled turbulence; turbulent flow (uncontrolled turbulence). Between the first and second characterisations, boundary layer separation may occur (e.g. formation of a stable, or time invariant, vortex or eddy) behind a bluff body placed in the channel, but without downstream effects. The second category of flow may occur when eddies associated with a perturbation body fluctuate or oscillate (unsteady eddies) without being shed but which oscillations are felt downstream (especially if the body is deformable) and at higher flow velocities when eddies or vortices are shed (von Karman Street vortex shedding).

We are particularly interested in the various categories of laminar flow. Vortex shedding (above Re≈47) is a partially turbulent flow, which, in this context, we would define as 'controlled turbulence' since whilst it is a flow instability it can be induced and can thereby enable control or influence of drop break up from the jet. Whilst the optimal position of the perturbation means (e.g. bluff body) will depend on these variables it is preferred that the position of the perturbation means will be fifteen channel widths or less from the orifice, more preferably ten channel widths or less, still more preferably five channel widths or less from the orifice.

Preferably, where the perturbation means is a bluff body such as a pillar, the bluff body is at least three body diameters from the orifice, more preferably at least five body diameters from the orifice. It is believed that by positioning the perturbation means too close to the orifice, interference may occur with the orifice that cause uncontrolled turbulence detrimental to the desired impact of the invention.

Where the perturbation means is a channel junction, corner or intersection within the microfluidic device, preferably the junction or corner is sufficiently distant from the orifice and preferably at least three channel widths.

An advantage of the present system over a piezo crystal is that in the piezo system, viscosity dampens perturbations. In the present system, the viscosity dampens the effect of shed vortices (i.e. lifetime shortened), but can be extended by pumping harder or changing the geometry of the system.

A jet of fluid in a device has a certain natural frequency of break up (discussed above—convection instability), in an uncontrolled manner whereby a specific average size of droplet will be formed for a viscosity and velocity of fluid through an orifice of a particular size (and shape, i.e. nozzle). In order for the vortices (or other flow instability) generated to influence the break up of the jet such that droplet size and dispersity can be controlled, the frequency of vortex shedding (or other flow instability) should preferably be in the order of the natural frequency of jet break up for the system.

In normal circumstances, a jet of fluid breaks up at the Rayleigh wavelength (this is typically in the region of 4.5 times the diameter of the jet, which for a thin nozzle will be approximately the nozzle diameter). Rayleigh jet break up is typically of an average droplet size depending on the characteristics of the fluid and the system (including the orifice radius r), although the droplet sizes typically represent a distribution. Rayleigh jet break up arises due to instability of a free jet (convective instability) as mentioned above.

The average size of the droplet formed in a free jet may be approximated for most fluids such that the average volume of the droplet is proportional to $9\pi r^3$ where r is the radius of the orifice. The average droplet radius is therefore approximately 1.89×the orifice radius.

The device utilised according to the present invention may depend on the use to which it is put. According to a desired droplet size of a particular fluid to be generated, the device will be selected to have a certain orifice diameter, since the characteristic average size of droplets formed in an unstable jet break-up emanating from an orifice depends upon the frequency, which itself is a function of the orifice diameter (and flow velocity).

Any suitable orifice size may be chosen depending upon the required droplet size according to the application for this device and method. It is expected that most applications for this device and method will be for the generation of droplets from the micron to millimetre range. As such, an orifice diameter useful for such applications may for example be within the range of about 1 μm to about 10 mm, preferably in the range of from about 4 μm to about 1 mm, more preferably to about 250 μm. In many of the applications such as continuous inkjet, pharmaceutical spray drying or spray freeze drying, etc, an orifice diameter of from about 10 μm to about 100 μm may be preferred.

For a particular fluid passing through an orifice of a predetermined size, there will, as mentioned above, be a characteristic Rayleigh frequency, which determines the natural frequency of jet break up in the droplet receiving space for that system. Preferably, a flow instability is associated with a frequency that may influence the break up of the jet, which flow instability frequency (e.g. vortex shedding frequency) is preferably within an order of magnitude of the Rayleigh frequency for the jet, preferably in a range of 0.1 to 5×the Rayleigh frequency, and more preferably in a range of from 0.25 to 1.4×the Rayleigh frequency and more preferably within 20%. Note that the flow instability frequency may be harmonically related to the frequency range around the Rayleigh frequency, i.e. be 0.5× or 1× or 2× or 3× etc and still effect an influence.

The frequency associated with the flow instability is a function of the nature of the fluid and of the diameter of the body (as well as the body diameter relative to the channel diameter). Accordingly, for a particular fluid, the frequency may be adjusted by utilising a bluff body, for example, having a diameter which, when applied in the above equation, is capable of producing flow instabilities of a particular frequency.

The channel width may be selected according to meeting various requirements of the system. One in particular is that the channel width is typically greater than the width of the orifice. As such, given that a single driving force typically is responsible for both fluid flow velocity in the fluid passing through the channel and emanating from the orifice, the fluid flow velocity in the channel will always be less than the fluid flow in the jet. Since a certain fluid flow rate is necessary to enable the critical Reynolds number to be reached, if the diameter of the channel is too great relative to the diameter of the orifice (for a particular system) then other detrimental effects (e.g. uncontrolled turbulence) may take effect before a fluid flow rate sufficient to achieve the Reynolds number for the system is reached. Further, in such a scenario, the jet emanating from the orifice and droplets formed therefrom may have such a high velocity that their utilisation in the droplet receiving space and thereafter is compromised and the performance of the system (e.g. a continuous inkjet printhead) is sub-optimal. Furthermore, since the frequency associated with fluid instabilities (such as vortex shedding) is dependent upon fluid flow velocity in the channel, the frequency thereby shifts outside the range of sensitivity of the jet break-up influence. Accordingly, selection of an appropriate channel width to orifice diameter ratio for any particular fluid system is important. In a typical system for a typically behaving fluid, it might be preferred therefore that the channel width, subject to the above conditions, is, for example, in the range of from about one and a half times the diameter of the orifice to about ten times the diameter, more preferably from about twice the diameter to about five times the diameter of the orifice. Preferably the channel is of circular or regular (e.g. square) cross-section. A typical microfluidic device channel according to preferred applications of the present invention may, for example, have a channel width in the region generally within the range from about 5 μm to about 5 mm, and for typical applications in the range from about 20 μm to about 500 μm, optionally in the range from about 50 μm to about 200 μm.

If the channel is too narrow, then other flow issues may have an effect. Similarly, if the passages between the walls of the channel and bluff body, as perturbation means, are too narrow, other effects take hold (e.g. restricted flow through the channels, impact on frequency of vortex shedding, uncontrolled turbulence, even suppression of vortex shedding).

In a preferred embodiment of the invention in which the perturbation means for passively creating a flow instability comprises a bluff body, the diameter of the bluff body relative the diameter of the channel and the diameter of the orifice is relevant since the size of the bluff body sets the frequency of vortex shedding as well as being a determinant of the critical Reynolds number for the system. Accordingly, a diameter of bluff body should be selected whereby, for the fluid system, the Reynolds number can be reached at a fluid flow velocity which doesn't become uncontrollably turbulent in the channel in which the bluff body is formed and enables a useful velocity of jet fluid and which allows the frequency of vortex shedding to be within the band of sensitivity for influence of the jet fluid break up.

Typically, subject to the above conditions for a particular system for a particular application and a particular fluid, the bluff body is preferably of a diameter from about 0.1 to 10 times the diameter of the orifice, more preferably, 0.2 to 2.5 times the diameter and still more preferably from about 0.5 to 1.5 times the diameter. The precise ratio (which may be out with these ranges) depends upon the nature of the system as a whole and the application thereof.

In the context of the present invention, a jet of fluid is defined as a flow of fluid, typically in a substantially columnar arrangement (but in any arrangement should be longitudinally extending in the direction of fluid flow), which has fluid-space or fluid-fluid interface boundaries. In the present invention, a jet is formed if a fluid emanates from an orifice into a droplet receiving space wherein there is a fluid interface between the contents of the fluid in the laminar fluid flow and the content of the fluid in the receiving space. This is consistent with the definition of a jet as in the review by Eggers and Villermaux, 'Physics Of Liquid Jets', *Rep. Prog. Phys.,* 71 (2008) 036601, being an authority on jets, with the additional proviso of a fluid interface.

In order for droplets to form from a jet in a droplet receiving space and therefore for controlled droplet formation according to the method of the present invention, for liquid-liquid systems, there is required sufficient interfacial tension between the droplet fluid and a carrier fluid (a fluid within which droplets may be formed) or the fluid occupying the droplet receiving space. For gas-liquid, liquid-gas or liquid-vacuum systems, sufficient surface tension is required for droplets to form.

Sufficient surface tension/interfacial tension means that there is needed a surface/interfacial tension such that for the droplets being produced in the drop receiving space, the droplets are formed before the jet of fluid dissipates into the carrier or puddles. This will typically depend upon the viscosity of the droplet fluid (and any carrier fluid), the flow rate of the droplet fluid and whether or not any carrier fluid is stagnant or is flowing or circulating. Preferably the interfacial tension is at least 5 mN/m, more preferably 10 mN/m or greater, and still more preferably 25 mN/m or greater. Preferably the surface tension of a droplet fluid formed in a gas, vapour or vacuum is at least 20 mN/m, more preferably 40 mN/m or greater and most preferably 50 mN/m or greater.

There is a velocity element, in practical application of the invention, to the above definition of a jet, being that the flow velocity must be such that a free jet is formed on exiting the orifice which requires that the force associated with the mass of fluid at the velocity driven must be greater than the surface tension that would keep the fluid attached to the tip of the nozzle or outside surface of the channel by the orifice. The velocity of droplets that form from a jet may be calculated as (Physicochemical hydrodynamics of capillary systems, V. V. Krotov, A. I. Rusanov, Imperial College Press 1999), $$U_{drop} = U_{jet} - \frac{\sigma}{\rho U_{jet} r}$$

With $U_{drop}$ the droplet velocity (m/s), $U_{jet}$ the jet velocity (m/s), $\sigma$ the surface tension (N/m), $\rho$ the density (kg/m$^3$), and r the radius of the jet (m). For the droplet velocity to be greater than zero therefore the jet velocity must be greater than, $$U_{jet} > \sqrt{\frac{\sigma}{\rho \cdot r}}$$

which for a water jet of 5 μm radius and surface tension of 72 mN/m, implies a minimum jet velocity of 2.7 m/s. More typically, this will require for a fluid having a surface tension in the region of water a fluid flow velocity through the orifice of at least 5 m/s, preferably in the range from about 5 m/s to about 30 m/s.

The frequency of vortex shedding (or other flow instability) may optionally be tuned or phase locked by applying a locking perturbation (using a locking means) to the system. In a typical drop size controlled system according to the present invention which relies on passive formation of fluid flow instability, very small adjustments in the flow velocity of the fluid may change the frequency of vortex shedding (or other flow instability) which may in turn have an impact on the size (and more particularly the degree of dispersity) of droplets produced by the device/method. Similarly, where multiple channels are used in parallel and simultaneous production and control of size of droplets is required, minor variations can cause the production of droplets to be out of phase and give rise to minor variations in size, which can be detrimental depending upon the application. Optionally, the vortex shedding (or other flow instability) in one or more parallel channels may be phase locked by the application of a locking perturbation. The locking perturbation may be an active or passive perturbation which is applied at a frequency close to the oscillating frequency of the vortex shedding system (or other flow instability oscillation). The energy (i.e. amplitude) of the locking perturbations does not need to be high (i.e. can be low energy). Typically, in the absence of the perturbation means passively creating flow instabilities in the droplet fluid phase, the locking perturbations would be of insufficient energy to cause such fluid instability or periodic perturbation capable of controlling or influencing droplet formation from a corresponding fluid jet from the location at which the locking perturbation is applied. This would be expected to be the case where the locking perturbation is an active means such as piezo electric pulses, application of heat or other active means. Preferably, the energy of the locking perturbation is 90% or less the energy required to cause drop formation-influencing fluid flow perturbations from the location the locking perturbation is applied, more preferably 50% or less, still more preferably 10% or less. The required closeness of the locking perturbation frequency to the frequency of vortex shedding depends upon the Q factor for the system (which is the sensitivity of the natural oscillation to locking). Typically, the locking perturbation will be within +/−10% of the vortex shedding frequency, possibly +/−5%.

If the locking perturbation is active, it may be selected from heaters (GB712861.4), electrophoresis, dielectrophoresis, electrowetting (also known as electrocapillarity), and/or piezo electric elements (see e.g. "ENGINEERING FLOWS IN SMALL DEVICES: Microfluidics Toward a Lab-on-a-Chip", H. A. Stone, A. D. Stroock, and A. Ajdari, Annu. Rev. Fluid Mech. 2004. 36:381-411).

By microfluidic device it is meant a device of capillaries suitable for pumping fluids through. This may include nanofluidic devices (e.g. those having a channel width in the nanometer range). However, it is believed that for most normal fluids, the channel width is likely to be 5 μm or greater in order that other factors (such as interaction with channel walls), capillary factors etc don't dominate.

The device may be made of any suitable material according to specific requirements (and the application) e.g. glass, silicon, plastic. Optionally, it is formed by a PDMS fabrication process. However, if the droplet fluid composition is aqueous and is not provided in laminar flow with a non-aqueous phase, the internal surfaces of the channel may be treated to ensure smooth laminar flow (since the PDMS surfaces are typically hydrophobic).

A nozzle may be provided as the exit orifice which is shaped to improve the transition of the fluid flow to the droplet receiving space and optionally to provide a desired shape. Typically the nozzle or orifice will be circular in order to produce a substantially columnar jet and more uniform droplets therefrom. The channel may be of any suitable profile, but is preferably substantially cylindrical internally.

Optionally, the geometry of the device is adjustable. By this it is meant that for a particular device with, for example, a fixed channel width, the size of the orifice or nozzle may be adjustable and/or the size and/or shape of the bluff body (as the perturbation means typically a pillar) may be adjusted (or the bluff body may be removed and replaced) and/or the longitudinal position of the bluff body may be adjusted. By this, the device may be readily modified for use with different fluid systems and/or for different drop sizes or applications. Alternatively, a fixed device may be separately manufactured for a particular application.

According to the invention, the droplets are formed in or delivered to a droplet receiving space. This droplet receiving space is typically external to the device, but may be a cavity formed within a device or device assembly. The droplet receiving space may define a carrier or receiving fluid, which may for example be gaseous (e.g. air) or liquid, or may define a vacuum or a gas or vapour phase carrier fluid at reduced pressure.

The droplet receiving space may be, for example a spray drying cylinder, a continuous inkjet printing space or other active space. The droplet receiving space may alternatively be defined by the walls of a larger conduit or cavity within the microfluidic device. In this, optionally a liquid carrier phase may be provided in which the droplets form. This may be cascaded through a further exit orifice from which complex droplets are formed in a monodisperse manner induced by the droplet phase droplet within. Droplets are thereby formed in a further receiving space, which may contain a further carrier phase or a vacuum.

Accordingly, the droplet generating method may be applied to the formation of a droplet of a liquid in a vacuum or in a gas or a liquid carrier. The droplet generating method may alternatively be applied to the formation of a droplet of gas in a liquid (i.e. formation of bubbles of controlled size).

The device and method of the invention as described herein, whilst being preferred for the generation of droplets of one droplet fluid phase in a droplet receiving space (which optionally contains a carrier phase), may be applied to more complex systems and in a variety of configurations.

For example, the device may comprise of a channel having a junction defining two or more upper channels (branches of the channel) converging to a single (or multiple) lower channel. The upper channels may carry individually, for example, a droplet phase or a carrier phase, whereby a two phase fluid system is formed in the lower channel. In this circumstance, the perturbation means may comprise the junction (e.g. at the confluence of the droplet and carrier fluid phases) or may comprise a bluff body such as a pillar placed in the fluid flow in the upper channel of either one or more of the droplet or carrier fluid flows or in the one or more lower channels. Preferably, where possible in such a multi-channel system the perturbation means is a bluff body in the lower channel.

Optionally, in a system in which laminar flow of two phases is provided in the channel and the perturbation means is a bluff body, the bluff body may be configured to cause flow instability primarily in only one phase in preference to the other (e.g. in a carrier phase or external phase which may be designated the outer fluid relative to the position in the channel). This may be beneficial in that the flow instability that will influence droplet formation from the two phase system as the fluid composition can be maintained primarily in the outer fluid in preference to the inner fluid. If the inner fluid comprises a sensitive material or particulate material, it may be desirable to avoid shear induced viscosity change in the inner fluid and this embodiment would achieve that aim. This may be achieved, for example, by providing a bluff body protruding from the wall of the channel in one or more positions in the channel (e.g. around a circumference) by an amount sufficient to cause flow instability in the outer fluid primarily.

In another configuration, for example, a channel may be provided with more than one orifice which jets of the fluid composition may emanate from into one or more droplet receiving spaces, which may be the same or different. Where a channel is provided with more than one orifice (which may be the same or different diameters), then each may be provided with a perturbation means, e.g. a bluff body such as a pillar, each of which perturbation means (e.g. bluff body) may optionally be of a different size/configuration/material and distance from its respective orifice, such respective arrangements being determined according to the nature of droplet control desired from each orifice. The flow instability cause by each bluff body will cascade to its respective orifice whereby desired droplet formation control/influence takes effect. Accordingly, a plurality of droplet streams from orifice from a single channel may be generated which have defined characteristics of droplet formation/size distribution.

The, or each, channel of the device of the present invention may alternatively be provided with a single outlet orifice.

It is particularly advantageous benefit of the present invention that relatively monodisperse droplets may be formed in a controlled manner, the degree of dispersity required depending on the particular application. In any case, in a preferred embodiment of the invention, the degree of dispersity (defined herein as the variation from the mean at the half-width half height of the droplet size distribution curve) is 20% or less from mean, more preferably 10% or less from mean, still more preferably 5% or less from mean, still more preferably 3% or less from mean and optionally 1% or less from mean.

The volume of drops formed is dependent upon volumetric flow rate and frequency of drop production. The rate of production corresponds to the rate of production of droplets in a free jet through a particular orifice at a particular velocity.

The method and device of the present invention finds use in a range of different applications. These include, for example, continuous inkjet printing, spray drying, spray freeze drying, nebulising inhalable medicines, formation of microcapsules, inkjet fabrication methodologies, capsule based electrophoretic displays, etc. Some of these are described below as specific embodiments of the invention, which should be considered as non-limiting on the invention as a whole.

In one embodiment, the method may be applied to continuous inkjet printing. According to this embodiment, it is preferred that droplets are formed in a droplet receiving space comprised of air (i.e. the carrier fluid is air) and the droplet fluid phase comprises the inkjet ink (or other fluid to be applied via continuous inkjet printing print heads. Typically, the droplet phase may be aqueous or solvent based, but is preferably aqueous. Droplet size is preferably in the region of from about 5 μm to about 500 μm, more preferably from about 10 μm to about 250 μm. Preferably, there is a very narrow distribution of sizes, e.g. the half-width half-height of the curve is up to 1% of the mean droplet size, preferably up to 0.5%.

Multiple such devices may be deployed in parallel for continuous inkjet printing according to the embodiment, in order to produce multiple streams of controlled droplets for printing. It is preferred, therefore, to deploy phase locking, as discussed above, in such circumstances.

For the purpose of continuous inkjet printing, the droplet fluid composition may contain dissolved or dispersed therein pigment or dye, stabilisers, humectants, polymers, monomers or other components optionally utilised for continuous inkjet printing inks.

In another embodiment, the method may be applied to production of inhalable medicines comprising at least an excipient and a drug moiety. For inhalable medicines it is well known to be particularly advantageous to have particles of a narrow size distribution with a mean size around 5 μm.

In yet a further embodiment, the method may be applied to the production of high quality capsules for use in capsule-based electrophoretic display technology. The requirements for this are described in U.S. Pat. No. 6,377,387, the contents of which as far as the droplet formation materials and their use are incorporated herein by reference. Preferably, for this purpose complex droplets are formed (i.e. droplets of one phase in the core with a shell of another phase) in a droplet receiving space which typically comprises air, inert gas or a vacuum. Preferably, the droplets formed are of a diameter in the range of about 20 μm to about 300 μm and the range of droplet size is within about 20%, preferably 5%, of the mean droplet size.

In a still further embodiment, the method may be applied to spray drying and/or manufacture of microcapsules, for example for controlled release pharmaceutical use.

The invention will now be further described with specific reference to the figures, by way of example only.

Figure 2:
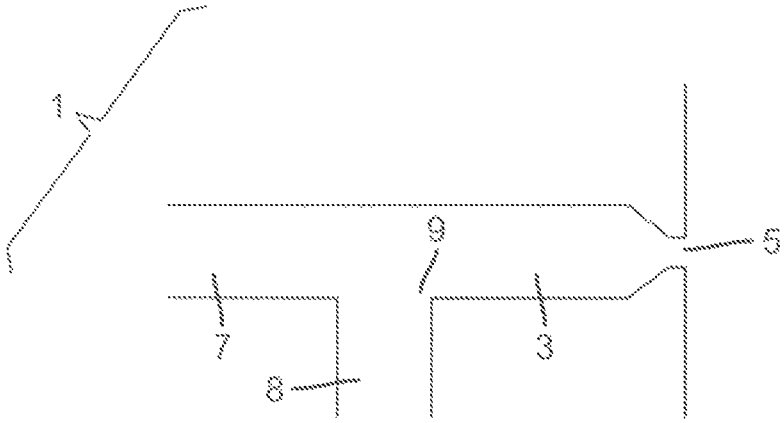
FIG. 2 shows a schematic drawing of the T-piece device used to create the image in FIG. 1.

FIG. 1 shows a water jet breakup in air from a T-piece device 1 shown schematically in FIG. 2. When pumping deionised water through both upper channels 7, 8 of the T piece device 1 with nozzle orifice 5 at a certain pressure and pressure ratio, very regular jet breakup occurred. This was unexpected.

It is believed that the junction 9 of the T piece device 1 was regularly shedding vortices which perturbed the nozzle flow initiating Rayleigh breakup. A calculation, using a rod as a von Karmen street generator, was subsequently made using Comsol Multiphysics, a commercial finite element modeling software.

It is clear that the Von Karmen street of vortices can interact with the nozzle to perturb the jet flow sufficiently to create regular droplets. This will be a rather general mechanism to create a droplet generator for, for example, continuous inkjet or other systems requiring jet breakup (e.g. flow cytometry) or particle manufacture. A variety of ways can be adopted for creating vortex streets within such a microfluidic device. However the Re number will typically be greater than a threshold of order 40. This is commensurate with continuous jet formation from a small orifice.

FIGS. 1 and 2 demonstrate the broad applicability of the present invention to a variety of simple microfluidic systems in that the carrier fluid is not required to be pumped as is the case with flow focusing devices. In this case the carrier fluid is air but could be another gas at any arbitrary pressure, either above or below atmospheric pressure. The droplet fluid composition in this example is deionised water and could be in principle any liquid which itself may contain other materials, including excipients, polymers, monomers, oligomers, surfactants, small molecules and particles, for example inorganic or organic particles or small liquid droplets dispersed within the droplet phase. The droplet fluid composition may also comprise the droplet phase and the carrier phase of a previous microfluidic device in a cascaded system.

Figure 3:
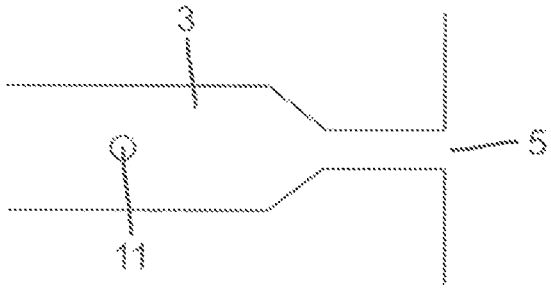
FIG. 3 shows a schematic drawing of an embodiment of the device in a simple configuration in which a pillar is formed in the channel of a microfluidic device.

In FIG. 3, a schematic view of a device according to the invention comprises orifice 5 for channel 3 which is provided with a pillar 11 as a bluff body for passively causing flow instability in fluid passing through the channel 3 and emanating as a jet from orifice 5 whereby the fluid instability will cause regular perturbations influencing jet break up.

Figure 4:
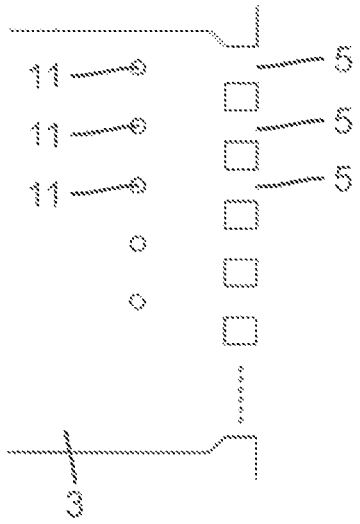
FIG. 4 is a schematic drawing of a device of the invention having a broad channel wherein one bluff body is provided for each of many orifices.

In FIG. 4, a plurality of orifices 5 are formed in a wide channel 3 wherein each orifice is provided a pillar 11 to effect a perturbation for said orifice. The result will be, when a fluid is passed with sufficient velocity through the channel, parallel drop production of controlled size droplets.

Figure 5:
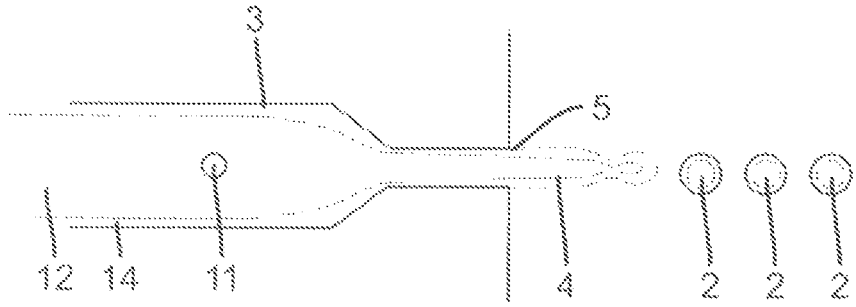
FIG. 5 is a schematic drawing of a device with a single channel and bluff body acting on a fluid composition comprising multiple fluid phases.

In FIG. 5, the effect of flow perturbation in a two phase fluid composition is illustrated. A first phase 12 and second phase 14, which are immiscible, form a droplet fluid composition passing through channel 3. Flow instability is introduced by the presence of pillar 11 which induces regular break up of the jet of fluid 4 emanating from orifice 5 to produce monodisperse two-phase droplets 2.

Figure 6:
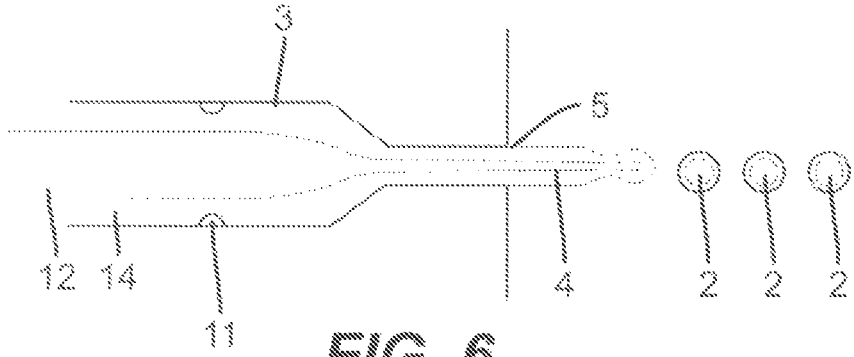
FIG. 6 is a schematic drawing of a device of FIG. 5 with a single channel and bluff body acting primarily on an outer fluid of a fluid composition comprising multiple fluid phases.

In FIG. 6, the effect of flow perturbation primarily targeted to the outer fluid of a two phase fluid composition is illustrated. A first (inner fluid) phase 12 and second (outer fluid) phase 14, which are immiscible, form a droplet fluid composition passing through channel 3. Flow instability is introduced primarily into the outer fluid 14 by the presence of a body 11 projecting from the channel wall into the channel by an amount sufficient to only or primarily directly perturb the flow of the outer fluid. This is advantageous where the inner fluid comprises particles or sensitive materials for which the shear viscosity associated with passing a bluff body is likely to be detrimental. As with FIG. 5, this flow instability induces regular break up of the jet of fluid 4 emanating from orifice 5 to produce monodisperse two-phase droplets 2.

In order to demonstrate the principle of vortex perturbation of a jet leading to droplet formation a pair of microfluidic flow focussing devices were prepared; one with pillars, one without.

Figure 7:
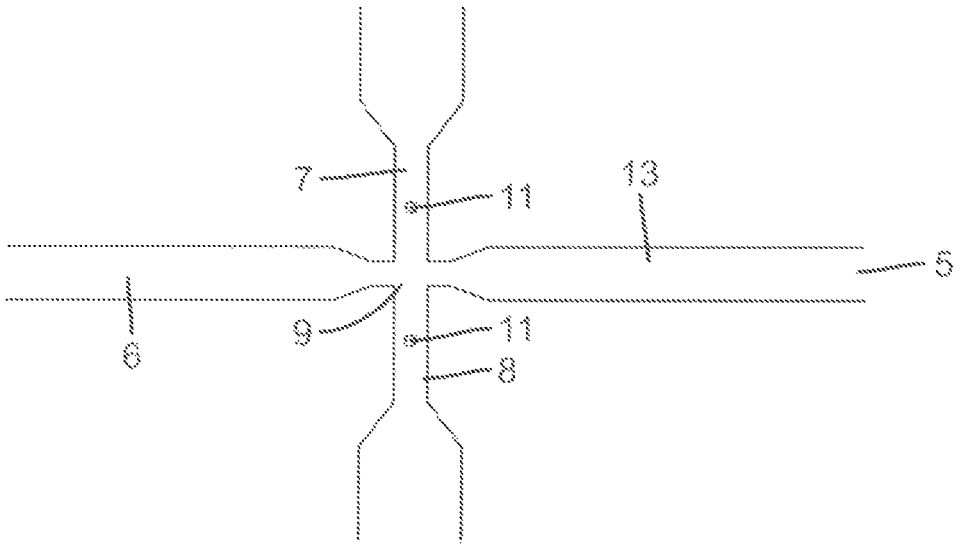
FIG. 7 is a schematic drawing of an embodiment of the invention in which three channels combine into a single channel whereby laminar flows of multiple phases may be perturbed according to the invention.

FIG. 7 is a schematic view of a further device according to the invention. The device in FIG. 7 has three upper channels 6, 7, 8 for the same or different fluid phases. The upper (or inlet) channels 6, 7, 8 meet at junction 9. Internal obstructions or pillars 11 of a 20 μm diameter are provided within the 70 μm diameter upper channels 7, 8. A lower channel 13 is provided downstream of the junction 9. The embodiment illustrated shows the junction as a flow focusing device.

The fluid phases may be water and/or oil. Optionally, in a multi-phase system one phase, the droplet phase is provided through upper channel 6 and the carrier fluid phase through upper channels 7, 8. Either or both of these fluid phases may contain one or more of particulates, dispersant, surfactant, polymer, oligomer, monomer, solvent, biocide, salt, cross-linking agent, precipitation agent.

Figure 8B:
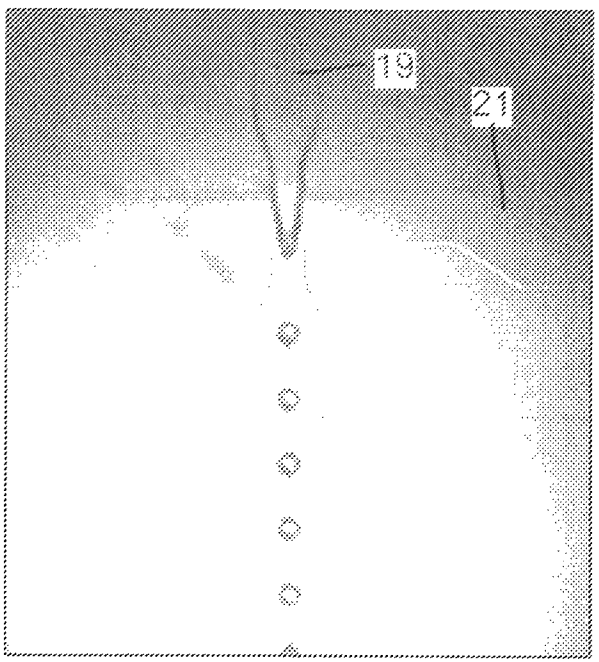
FIGS. 8 & 9 show images of monodisperse water in oil drop formation with pillars (FIGS. 8*a* and 9*a*) compared with an unbroken thread for the device without pillars (FIGS. 8*b* and 9*b*)
Figure 8A:
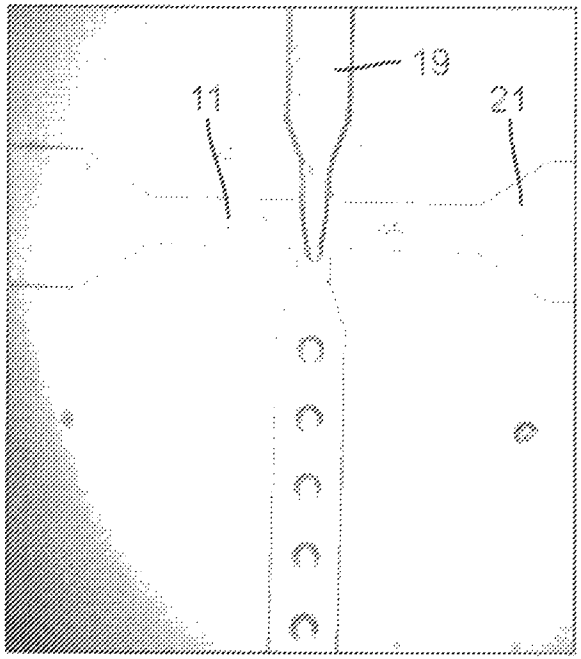

A device such as that shown in FIG. 6 was constructed in PDMS and tested for flows of water 19 against hexadecane as the oil phase 21. A similar device but without the pillars 11 in the outer upper flow channels 7, 8 was also constructed and tested. The fluid flows are driven by pressure and so for low pressure (i.e. ~15 psi oil phase and 12 psi water phase) and therefore low flow velocities and lower Reynolds number the expected dripping regime was observed for devices both with and without pillars (see FIG. 8).

Figure 9B:
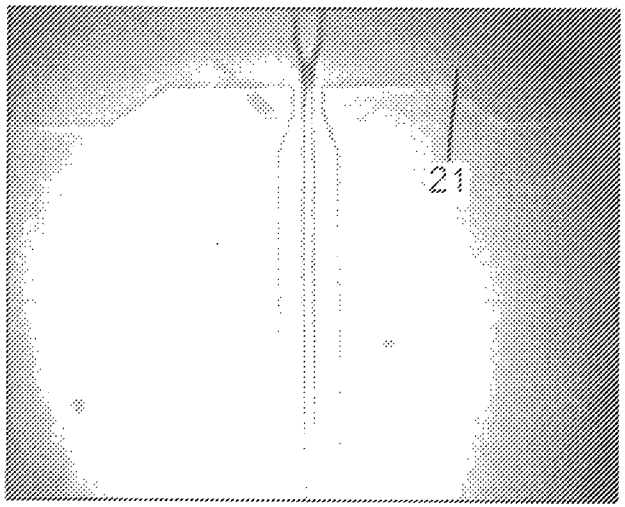
Figure 9A:
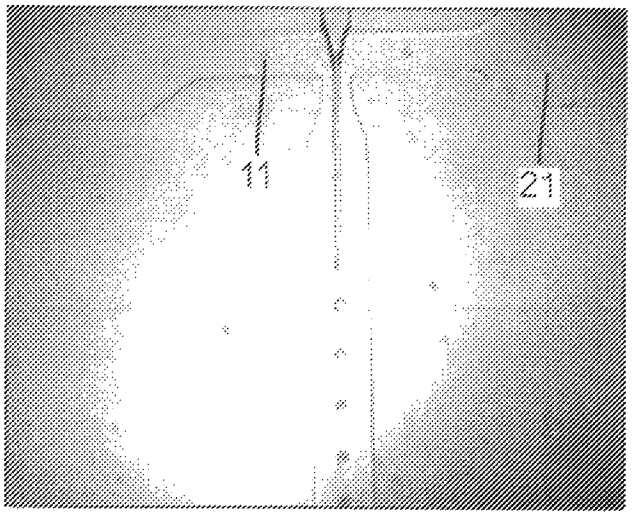

As the pressure of both fluids is increased the dripping mode transitions to a jetting mode for both devices and images can be recorded for an extended thread of water breaking into drops. However these are not particularly monodisperse in size. By increasing the oil and water pressure further a threshold condition is passed as the fluid velocities and therefore Reynolds number for the flow increases. Above this threshold condition the vortex perturbations from flow passing the pillars 11 causes the break-up of the water thread in a regular fashion giving high frequency monodisperse drops of water in oil (see FIG. 9*a*). For the device without pillars 11 under the same conditions it is only possible to generate a stable unbroken thread of water in oil that persists over the full 5 mm distance between the flow focussing region and exit port (see FIG. 9*b*).

It was noted that the pillars 11 are able to oscillate as the flow passed. The material used for the device is not critical. However, it is necessary that the inner surface of the channels 7, 8 and the lower channel 13 are preferentially wetted by the carrier fluid otherwise either the thread of the droplet phase or the droplets or both will adhere to a channel wall.

A calculation was performed to model the flow in the device as described above. At low flow rates although vortices exist downstream of each pillar 11, there is no instability. However, above a critical flow rate, an oscillation appears, even with a single phase.

In the embodiment illustrated in FIG. 7 the pillars 11 are located in the upper channels 7, 8. The invention is not limited to this embodiment. The pillars may be provided in upper channel 6. It is also possible for all upper channels to be provided with pillars. Equally there may be only one upper channel 6. To further disturb the flow within the channels in order to phase lock the droplet formation, a heating element, or electrodes for electrophoresis or dielectrophoresis or electroosmosis may be located adjacent any of the carrier fluid channels 7,8.

It will be obvious to one skilled in the art that the first and second immiscible phases can be reversed provided the wettability of the internal surfaces of the microfluidic channels is also reversed i.e. made to be preferentially wet by the carrier phase instead.

Figure 10:
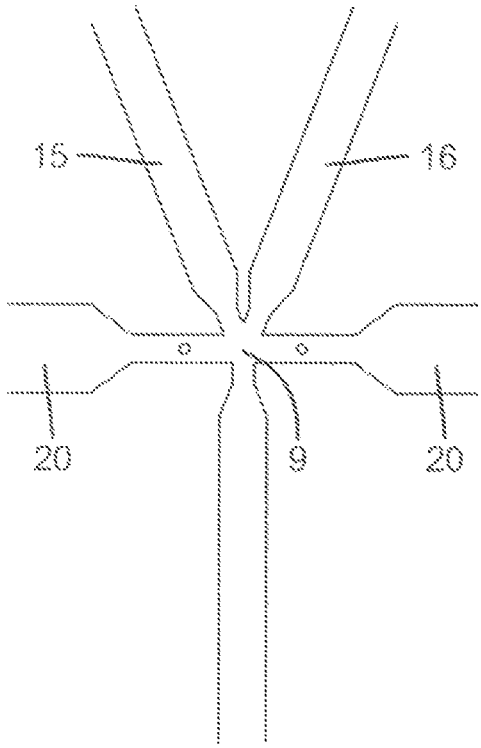
FIGS. 10, 11 & 12 are schematic drawings of other multiple channel devices.
Figure 11:
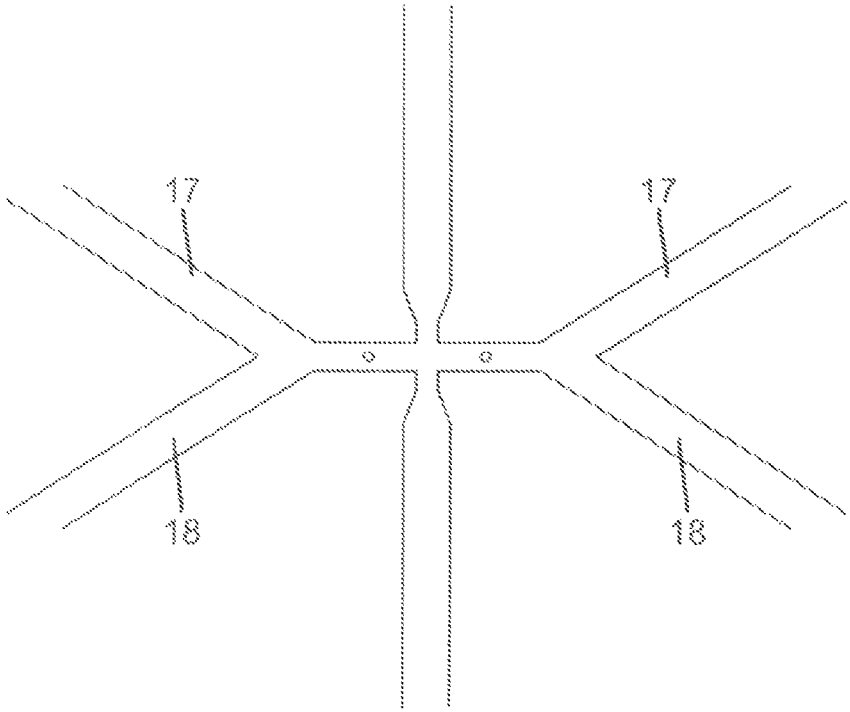
Figure 12:
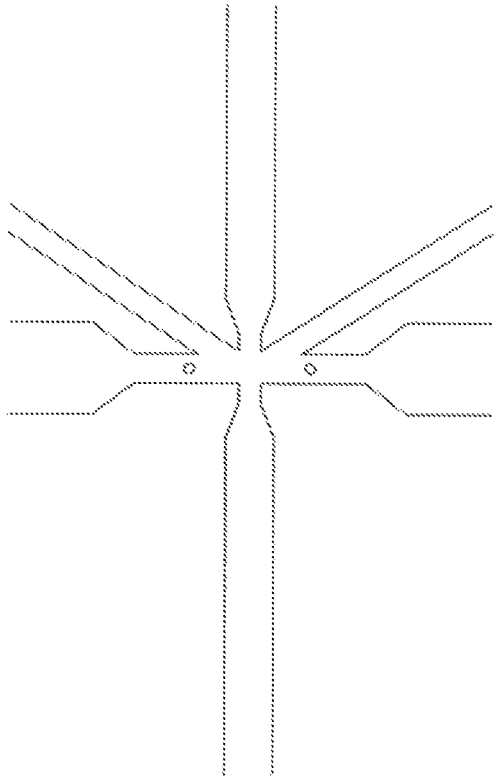

The device as described may be extended to create more complex multiphase droplets by providing additional liquids via additional inlet channels. Each additional inlet may comprise either the same or additional fluid phases and each fluid phase may additionally contain one or more of particulates, dispersant, surfactant, polymer, oligomer, monomer, solvent, biocide, salt, cross-linking agent, precipitation agent. An example of a more complex drop would be a Janus droplet whereby a droplet phase is supplied as two parts via two upper channels 15,16 that meet at or prior to the junction 9 with the carrier fluid channels 20. Such an arrangement is shown in FIG. 10. The droplet phase supplied in the two channels may contain differing additional components. A further example of an arrangement to generate a more complex drop would be that required to generate a core-shell system. Such an arrangement is shown in FIGS. 11 and 12. Here the carrier phase is supplied as two parts via upper channels 17, 18: a first part in upper channel 17 that contacts the droplet phase and a second part in channel 18 that does not contact the droplet phase but from which a component may diffuse to the droplet phase and which causes at least the outer part of the droplet phase to precipitate or cross link thereby encasing the droplet phase. These are examples of more complex arrangements and do not limit the scope of the invention.

Devices such as that shown in FIG. 2, 3, 4, 5, 6 or 7 may be cascaded, i.e. placed in series on a microfluidic chip to create a more complex droplet or may be connected in parallel to create droplets at a higher integrated rate. Further the devices may be advantageously combined with other microfluidic elements, e.g. mixers, sorters, concentrators, diluters, UV curers etc. to create specifically designed materials.

It is shown that introduction of perturbations, such as bluff bodies, pillars in this case, into the fluid flow can cause flow oscillations that in turn cause very regular perturbations to the liquid thread or fluid jet emanating from an orifice leading from the channel. These perturbations of the liquid thread initiate a Rayleigh-Plateau instability in turn causing the thread to break very regularly. Such regularity enables monodisperse droplets to be manufactured at very high speeds.

Example Embodiments of the Invention

1. A method of controlling the formation of droplets of a droplet fluid composition from a jet of the droplet fluid composition, the method comprising providing a microfluidic device having at least one channel for the passage of the droplet fluid composition leading via an orifice to a droplet receiving space, providing a perturbing means for passively causing a flow instability within the channel, and causing the droplet fluid composition to pass through the channel at sufficient velocity to form a jet of said fluid emanating from the orifice whereby the fluid flow may be perturbed by the perturbation means for passively causing a flow instability thereby influencing the formation of droplets received in the droplet receiving space.

2. The method as described in item 1, whereby the fluid flow is periodically perturbed.

3. The method as described in item 1, which method controls or influences the formation of droplets of a droplet fluid composition in a vacuum or a carrier phase, which vacuum or carrier fluid phase are contained within the droplet receiving space.

4. The method as described in any one of items 1 to 3, wherein the carrier phase is air and the droplet composition is a liquid.

5. The method as described in any one of items 1 to 4, wherein the droplet fluid composition is a single droplet fluid phase.

6. The method as described in any one of items 1 to 5, wherein the flow instability is such that vortices are periodically shed.

7. The method as described in any one of the preceding items, wherein the perturbation means for passively causing a flow instability within the channel is a bluff body.

8. The method as described in item 7, wherein the bluff body is a pillar formed within the channel.

9. The method as described in item 7 or item 8, wherein the bluff body is capable of oscillating within the channel in response to fluid flow.

10. The method as described in any one of the preceding items, wherein the droplet fluid composition is an aqueous phase composition.

11. The method as described in any one of the preceding items, wherein the droplet fluid composition has particles, reagents or components dissolved and/or dispersed therein.

12. The method as described in any one of the preceding items, which is a method for generating droplets of a droplet fluid composition, wherein the range of size dispersity of the droplets formed is, at half height on the distribution curve, +/−5% based on the mean droplet size.

13. The method as described in any one of the preceding items, wherein the droplet fluid composition comprises at least two phases, an outer fluid in contact with the inner surface of the channel and an inner fluid which populates interior portion of the channel, and wherein the perturbing means is provided such as to cause flow instability primarily in the outer fluid whereby the inner fluid remains relatively unperturbed until drop formation occurs on passing through the orifice when the flow instability induced in the outer fluid takes effect in influencing drop formation.

14. The method as described in any one of items 1 to 13, which is for generating droplets for continuous inkjet printing.

15. The method as described in any one of items 1 to 13, which is for generating droplets for spray drying.

16. The method as described in any one of items 1 to 13, which is for generating droplets for crop spraying.

17. The method as described in any one of items 1 to 13, which is for generating droplets for nebulising inhalable medicines.

18. The method as described in any one of items 1 to 13, for use in the manufacture of pharmaceuticals.

19. A microfluidic device for forming droplets of a droplet fluid composition the device comprising at least one channel for the passage of said droplet fluid composition, at least one outlet orifice leading to a droplet receiving space and a means for creating a flow velocity of the droplet fluid within the channel, wherein the at least one channel is provided with a perturbation means for passively creating flow instability of fluid passing through the channel whereby droplets of fluid are formed from a jet of said fluid exiting the orifice into the droplet receiving space in a regular manner that is influenced by creation of flow instability in the fluid.

20. A microfluidic device as described in item 19, wherein the perturbation means is provided by a geometric arrangement of two or more channels within the device.

21. A microfluidic device as described in item 19, wherein the perturbation means is provided by at least one bluff body positioned within the at least one channel.

22. A microfluidic device as described in item 21, wherein the perturbation means is provided by a single bluff body positioned within the at least one channel.

23. A microfluidic device as described in item 21 or item 22, wherein the bluff body is a pillar.

24. A microfluidic device as described in any one of items 21 to 23, wherein the bluff body is capable of oscillating within the channel in response to the fluid flow.

25. A microfluidic device as described in any one of items 19 to 24, which further comprises a locking means for providing a locking perturbation to phase lock one or more parallel flow instabilities.

26. A microfluidic device as described in item 25, wherein the locking means is an active perturbation means.

27. A microfluidic device as described in any one of items 19 to 26, wherein the perturbation means for passively creating flow instability is positioned fifteen channel widths or less from the orifice.

28. A microfluidic device as described in item 27, wherein the perturbation means is positioned ten channel widths or less, preferably five channel widths or less from the orifice.

29. A microfluidic device as described in any one of the preceding items, wherein the perturbation means comprises a bluff body protruding part way into the channel from a channel wall whereby it is capable of inducing a flow instability primarily in an outer portion of a droplet fluid composition.

30. A microfluidic device for forming droplets of a droplet fluid composition, the device comprising at least one channel for the passage of said droplet fluid composition, at least one orifice leading to a droplet receiving space and a means for creating a flow velocity of the droplet fluid within the channel sufficient to generate a jet of fluid through the orifice, wherein the at least one channel is provided with a bluff body.

31. A microfluidic device as described in item 30, wherein the bluff body is positioned such that at the flow velocity it causes the formation of a vortex street.

32. A microfluidic device as described in item 30 or item 31, which further comprises the features of any one of items 19 to 29.

33. A microfluidic device assembly comprising a plurality of microfluidic devices as defined in any one of items 19 to 32 arranged in parallel and/or in series.

34. A continuous inkjet printhead comprising a microfluidic device for generating droplets of an inkjet ink, said microfluidic device being as defined in any one of items 19 to 32.

35. A nebuliser comprising at least one microfluidic device as defined in any one of items 19 to 32.

36. Use of a microfluidic device, comprising at least one channel for the passage of fluid, at least one outlet orifice and a perturbation means for creating fluid flow instability through the channel, for controlling the formation of droplets of a droplet fluid phase into a droplet receiving space, by passing the droplet fluid phase through the device at a velocity sufficient to cause a jet of said fluid to emanate from the outlet orifice and to induce the perturbation means to create fluid flow instability in the channel.

37. A use as described in item 36, in which the fluid flow instability involves the shedding of vortices from the perturbing means.

38. A method of influencing or controlling droplet formation from a jet of fluid emanating from an orifice of a microfluidic device, the method comprising inducing a vortex street to cascade through the orifice.

The invention claimed is:

1. A method of controlling the formation of droplets of a droplet fluid composition from a jet of the droplet fluid composition, the method comprising providing a microfluidic device having at least one channel for the passage of the droplet fluid composition leading via an orifice to a droplet receiving space, providing a perturbing means within the channel that passively creates a periodic flow instability within the channel that controls the formation of droplets in the fluid composition, causing the droplet fluid composition to pass through the channel at sufficient velocity to form a jet of said fluid emanating from the orifice, and controlling the formation of droplets received in the droplet receiving space by creating a passive periodic flow instability in the droplet fluid composition by causing the droplet fluid composition to flow by the perturbation means as the droplet fluid composition passes through the channel.

2. The method as claimed in claim 1, the method controlling the formation of droplets of a droplet fluid composition in a vacuum or a carrier phase, wherein the vacuum or carrier fluid phase are contained within the droplet receiving space.

3. The method as claimed in claim 1, wherein the carrier phase is air and the droplet composition is a liquid.

4. The method as claimed in claim 1, wherein the droplet fluid composition is a single droplet fluid phase.

5. The method as claimed in claim 1, wherein the flow instability is such that vortices are periodically shed.

6. The method as claimed in claim 1, wherein the perturbation means for passively causing a flow instability within the channel is a bluff body.

7. The method as claimed in claim 6, wherein the bluff body is a pillar formed within the channel.

8. The method as claimed in claim 6, wherein the bluff body is capable of oscillating within the channel in response to fluid flow.

9. The method as claimed in claim 1, wherein the droplet fluid composition is an aqueous phase composition.

10. The method as claimed in claim 1, wherein the droplet fluid composition has particles, reagents or components dissolved and/or dispersed therein.

11. The method as claimed in claim 1, which is a method for generating droplets of a droplet fluid composition, wherein the range of size dispersity of the droplets formed is, at half height on the distribution curve, +/−5% based on the mean droplet size.

12. The method as claimed in claim 1, wherein the droplet fluid composition comprises at least two phases, an outer fluid in contact with the inner surface of the channel and an inner fluid which populates interior portion of the channel, and wherein the perturbing means is provided such as to cause flow instability primarily in the outer fluid whereby the inner fluid remains relatively unperturbed until drop formation occurs on passing through the orifice when the flow instability induced in the outer fluid takes effect in influencing drop formation.

13. The method as claimed in claim 1, which is for generating droplets for continuous inkjet printing.

14. The method as claimed in claim 1, which is for generating droplets for spray drying.

15. The method as claimed in claim 1, which is for generating droplets for crop spraying.

16. The method as claimed in claim 1, which is for generating droplets for nebulising inhalable medicines.

17. The method as claimed in claim 1, for use in the manufacture of pharmaceuticals.

18. The method as claimed in claim 1, the periodic flow instability of the fluid flow having a frequency, wherein the frequency of the periodic flow instability is within an order of magnitude of the Rayleigh frequency for the jet of the fluid emanating from the orifice.

19. A microfluidic device for forming droplets of a droplet fluid composition, the device comprising at least one channel for the passage of said droplet fluid composition, at least one outlet orifice leading to a droplet receiving space and a means for creating a flow velocity of the droplet fluid within the channel, wherein a perturbation means is provided within the at least one channel that passively creates a periodic flow instability of fluid passing through the channel as the fluid flows by the perturbation means to control in a regular manner formation of droplets of fluid from a jet of said fluid exiting the orifice into the droplet receiving space.

20. A microfluidic device as claimed in claim 19, wherein the perturbation means is provided by a geometric arrangement of two or more channels within the device.

21. A microfluidic device as claimed in claim 19, wherein the perturbation means is provided by at least one bluff body positioned within the at least one channel.

22. A microfluidic device as claimed in claim 21, wherein the perturbation means is provided by a single bluff body positioned within the at least one channel.

23. A microfluidic device as claimed in claim 21, wherein the bluff body is a pillar.

24. A microfluidic device as claimed in claim 21, wherein the bluff body is capable of oscillating within the channel in response to the fluid flow.

25. A microfluidic device as claimed in claim 19, which further comprises a locking means for providing a locking perturbation to phase lock one or more parallel flow instabilities.

26. A microfluidic device as claimed in claim 25, wherein the locking means is an active perturbation means.

27. A microfluidic device as claimed in claim 19, wherein the perturbation means for passively creating flow instability is positioned fifteen channel widths or less from the orifice.

28. A microfluidic device as claimed in claim 27, wherein the perturbation means is positioned ten channel widths or less, preferably five channel widths or less from the orifice.

29. A microfluidic device as claimed in claim 19, wherein the perturbation means comprises a bluff body protruding part way into the channel from a channel wall whereby it is capable of inducing a flow instability primarily in an outer portion of a droplet fluid composition.

30. A microfluidic device as claimed in claim 19, the perturbation means being,nrovided by at least one bluff body positioned within the at least one channel, wherein the bluff body is positioned such that at the flow velocity it causes the formation of a vortex street.

31. A microfluidic device assembly comprising a plurality of microfluidic devices as defined in claim 19 arranged in parallel or in series or a combination of both.

32. A continuous inkjet printhead comprising a microfluidic device for generating droplets of an inkjet ink, said microfluidic device being as defined in claim 19.

33. A nebuliser comprising at least one microfluidic device as defined in claim 19.

34. Use of a microfluidic device, comprising at least one channel for the passage of fluid, at least one outlet orifice and a perturbation means positioned within the channel that passively creates a periodic flow instability within the channel that controls the formation of droplets of a droplet fluid phase into a droplet receiving space, by passing the droplet fluid phase through the device at a velocity sufficient to cause a jet of said fluid to emanate from the outlet orifice and to induce the perturbation means to create fluid flow instability in the channel by causing the droplet fluid phase to flow by the perturbation means as the droplet fluid phase passes through the channel.

35. A use as claimed in claim 34, in which the fluid flow instability involves the shedding of vortices from the perturbing means.

36. A use as claimed in claim 35, in which the vortices shed from the perturbing means cascade through the orifice.

37. A method of controlling the formation of droplets of a droplet fluid composition from a jet of the droplet fluid composition, the method comprising providing a microfluidic device having at least one channel for the passage of the droplet fluid composition leading via an orifice to a droplet receiving space, providing a perturbing means for passively causing a flow instability within the channel, and causing the droplet fluid composition to pass through the channel at sufficient velocity to form a jet of said fluid emanating from the orifice whereby the fluid flow may be perturbed by the perturbation means for passively causing a flow instability thereby influencing the formation of droplets received in the droplet receiving space, wherein the droplet fluid composition comprises at least two phases, an outer fluid in contact with the inner surface of the channel and an inner fluid which populates interior portion of the channel, and wherein the perturbing means is provided such as to cause flow instability primarily in the outer fluid whereby the inner fluid remains relatively unperturbed until drop formation occurs on passing through the orifice when the flow instability induced in the outer fluid takes effect in influencing drop formation.

38. A microfluidic device for forming droplets of a droplet fluid composition the device comprising at least one channel for the passage of said droplet fluid composition, at least one outlet orifice leading to a droplet receiving space and a means for creating a flow velocity of the droplet fluid within the channel, wherein the at least one channel is provided with a perturbation means for passively creating flow instability of fluid passing through the channel whereby droplets of fluid are formed from a jet of said fluid exiting the orifice into the droplet receiving space in a regular manner that is influenced by creation of flow instability in the fluid, wherein the microfluidic device further comprises a locking means for providing a locking perturbation to phase lock one or more parallel flow instabilities.

* * * * *